United States Patent [19]

Beretta

[11] Patent Number: 4,467,546

[45] Date of Patent: Aug. 28, 1984

[54] GUN BARREL CHOKE

[75] Inventor: Pier C. Beretta, Brescia, Italy

[73] Assignee: Fabrica D'Armi P. Beretta S.p.A., Italy

[21] Appl. No.: 384,990

[22] Filed: Jun. 4, 1982

[30] Foreign Application Priority Data

Dec. 6, 1981 [IT] Italy ..... 7010/82[U]

[51] Int. Cl.[3] ..... F41C 21/18

[52] U.S. Cl. ..... 42/79; 16/109

[58] Field of Search ..... 42/79; 89/14 B, 14 C, 89/14 D, 14 E; 16/108, 109

[56] References Cited

U.S. PATENT DOCUMENTS

| | | | |
|---|---|---|---|
| 1,057,763 | 4/1913 | Mueller et al. | 16/109 |
| 1,455,661 | 5/1923 | Rhinehart | 42/79 |
| 2,340,821 | 2/1944 | Russell | 42/79 |
| 2,807,903 | 10/1957 | Wheeler | 42/79 |
| 2,953,972 | 9/1960 | Sorensen | 89/14 C |
| 4,386,477 | 6/1983 | Briley | 42/79 |

FOREIGN PATENT DOCUMENTS

| | | | |
|---|---|---|---|
| 679744 | 1/1965 | Italy | 42/79 |

*Primary Examiner*—Charles T. Jordan
*Assistant Examiner*—Ted L. Parr
*Attorney, Agent, or Firm*—McGlew and Tuttle

[57] ABSTRACT

A choke for a shotgun barrel comprises a sleeve body having an outer cylindrical surface and an inner surface with a conical rear section and a cylindrical front section. The conical section rearwardly widens from a mouth thereof and the sleeve body is positioned rigidly within a seat provided longitudinally in the gun barrel. The gun barrel has an inner diameter equal to the outer diameter of the sleeve body and an inclined plane surface defining a seat for receiving a bevelled extremity of the sleeve body. The inclined surface and bevelled extremity both form acute angles with the longitudinal axis of the barrel. An annular threaded projection on the outer surface of the sleeve body is threaded onto an externally threaded ferrul provided on the gun barrel.

4 Claims, 2 Drawing Figures

GUN BARREL CHOKE

FIELD OF THE INVENTION

The present invention is related to choking means for gun barrels, particularly shotguns, such choking means or choke being placed inside the barrel's mouth and being securely positioned by means of a threaded ferrule or ring threaded to the outside of the barrel.

BRIEF DESCRIPTION OF THE PRIOR ART

Several types of barrel chokes are known already for use with guns, the purpose being that of reducing the barrel diameter and thus increase the firing range and restrict the target or pattern area. Such known chokes are applied to the barrel and used therewith generally as "extensions" of the barrel itself and, as such, are often subjected to vibrations and exposed to shocks which might alter the alignment of the choke with respect to the axis of the barrel, thus jeopardizing the targeting precision and the uniformity of the pattern of the exiting pellets or shot.

SUMMARY OF THE INVENTION

It is therefore, an object of the present invention to provide a gun barrel choke which is positioned substantially within the barrel to insure continuous perfect alignment with the axis of the barrel and to insure the firing precision and, concurrently, higher ballistic efficiency.

It is another object of the present invention to provide a gun barrel choke having an inner surface that is a perfect continuation of the surface of the barrel, while eliminating vibration and other effects on the precision and targeting formation of the disclosed pellets.

BRIEF DESCRIPTION OF THE DRAWINGS

These and other objects of the invention will become apparent from the following detailed description thereof and from the accompanying drawings, illustrative but not limitative of the invention, in which.

DESCRIPTION OF THE PREFERRED EMBODIMENT

Figure 1:
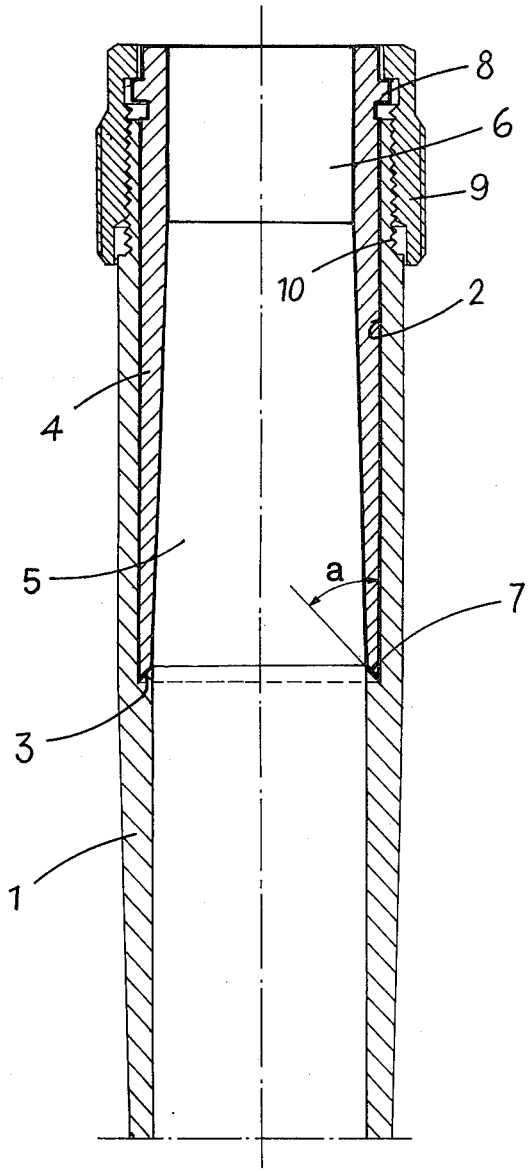
FIG. 1 is a sectional, longitudinal view of the choke and of a section of the gun barrel.
Figure 2:
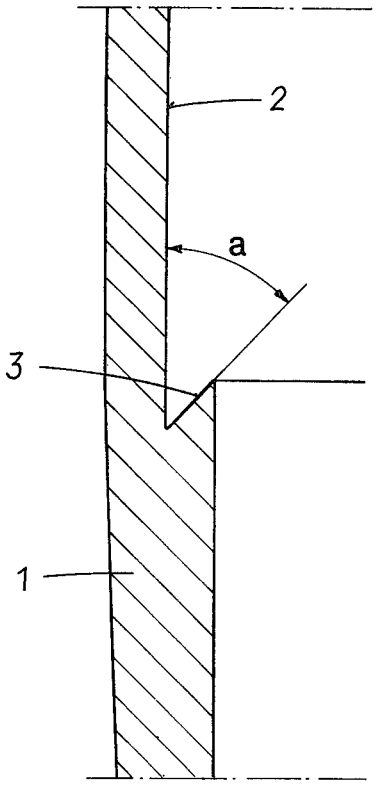
FIG. 2 is a sectional view of a detailed portion of the choke.

Referring now the accompanying drawings, the gun barrel 1 is provided on the inner surface of its mouth with a cylindrical seat 2 which forms a widening of the barrel opening. Seat 2 terminates in the interior of barrel 1 in an inclined shoulder 3, thus forming an annular inclined plane having an acute angle a with the inner surface of the seat 2, as shown in FIG. 2.

Within the cylindrical seat 2 there is positioned the choke or restricting means 4 which consists of a sleeve having an outer cylindrical surface of diameter corresponding to the diameter of the cylindrical seat 2.

Interiorly, choke 4 is provided with a conical section 5 which widens from the mouth 6 of the barrel backwardly toward the interior of the barrel, section 5 having at its innermost extremity a diameter corresponding to that of the barrel itself.

Choke 4 has, furthermore, at its rearmost extremity, a bevel 7 which complements the shoulder 3 provided on the interior of the barrel, so as to obtain a perfect mating of the terminal bevel 7 with the inclined shoulder 3 when the choke 4 is applied to the barrel 1 of the gun. The purpose of this is to have a perfect continuity of the inner surface of the barrel.

Finally, choke 4 is provided in the proximity of the barrel mouth 6 with an outer annular projection 8 associated with a fastening or securing ring or ferrule 9. Ferrule 9 has inner threading which engages a corresponding outer threaded area 10 provided on the outside surface of the mouth 6 of the barrel 1.

In accordance with the invention, as above described, choke 4, when assembled on the barrel, is fully inserted within the barrel and resting in the seat 2 to give a perfectly centered and axially stable assembly capable of offering the advantages described hereinabove.

I claim:

1. A choke for a gun barrel comprising a sleeve body having an outer cylindrical surface and an inner surface with a conical rear section and a cylindrical front section, said conical section rearwardly widening from a mouth thereof; said sleeve body being positioned rigidly within a seat provided longitudinally in said gun barrel and having an inner diameter equal to an outer diameter of said sleeve body; a rear bevelled extremity in said sleeve body mating an inclined plane surface provided on said seat; and an annular threaded projection on the outer surface of said sleeve body associated with a threaded ferrule provided on said gun barrel for connecting said sleeve body to said gun barrel; said bevelled extremity and said inclined plane surface forming an acute angle with a longitudinal axis of the gun barrel.

2. The gun barrel choke of claim 1, wherein said conical rear section of said inner surface of said sleeve body has a maximum diameter equal to the inner diameter of said gun barrel.

3. A combination gun barrel and choke comprising:

a sleeve body having an open mouth and a cylindrical outer surface, with a conical inner surface narrowing toward said mouth;

said barrel having a muzzle end with a seat defined by a cylindrical surface with an inner diameter equal to an outer diameter of said sleeve body cylindrical outer surface, said seat including an inclined shoulder extending at an acute angle to a longitudinal axis of said barrel and extending inwardly from said seat cylindrical surface to a remaining inner surface of said barrel;

said sleeve body having a rear bevelled extremity spaced from said mouth and seated against said inclined shoulder with said cylindrical outer surface of said sleeve body seated against said cylindrical surface of said seat;

a maximum diameter of said conical inner surface disposed adjacent said inclined shoulder and having a diameter equal to a diameter of said inner remaining surface of said barrel;

said barrel including external threads adjacent said muzzle end thereof; and an annular threaded member engaged with said sleeve body and threaded onto said external threads for urging said sleeve body into engagement with said barrel seat.

4. A combination gun barrel and choke according to claim 3, wherein said sleeve includes an outer annular projection adjacent said mouth thereof, said threaded member including an annular recess for receiving said annular projection.

* * * * *